United States Patent [19]

Castelot et al.

[11] Patent Number: 4,508,384

[45] Date of Patent: Apr. 2, 1985

[54] PREGNANCY-SUPPORTING LOUNGE CHAIR

[76] Inventors: Lawrence E. Castelot; Linda A. Castelot, both of 168 Glendale Ave., Bridgeport, Conn. 06606

[21] Appl. No.: 424,402

[22] Filed: Sep. 27, 1982

[51] Int. Cl.[3] ..... A47C 1/024

[52] U.S. Cl. ..... 297/284; 5/431; 297/108; 297/283

[58] Field of Search ..... 297/108, 284, 283; 5/431, 462

[56] References Cited

U.S. PATENT DOCUMENTS 2,462,675 2/1949 Reiman ..... 297/108 X
3,378,862 4/1968 Skinner ..... 5/462
4,021,872 5/1977 Powell ..... 5/462

FOREIGN PATENT DOCUMENTS 1079143 11/1954 France ..... 297/108

*Primary Examiner*—William E. Lyddane
*Assistant Examiner*—Peter R. Brown

[57] ABSTRACT

This pregnancy-supporting lounge chair is designed to support a pregnant woman's stomach safely and comfortably, when she lies in prone position, and it can also comfortably seat a person when desired. Primarily, it consists of a main seat frame with a backrest and a footrest, and it further includes a second seat frame, to cover an open area in the main seat frame, containing an adjustable stretch band, which supports the woman's stomach when she is in the face-down prone position.

3 Claims, 3 Drawing Figures

PREGNANCY-SUPPORTING LOUNGE CHAIR

This invention relates to furniture, and more particularly, to a pregnancy-supporting lounge chair.

The principal object of this invention is to provide a pregnancy-supporting lounge chair, which will be especially designed to give the comfort and support which a pregnant woman needs when lying on her stomach.

Another object of this invention is to provide a pregnancy-supporting lounge chair, which will be unique and novel, in that it will include an additional folding leaf portion, for enabling the covering of a stretch band in the main body portion of the structure.

Another object of this invention is to provide a pregnancy-supporting lounge chair, which will be of such structure, that it will fold into compact form for easy storage.

A further object of this invention is to provide a pregnancy-supporting lounge chair, which will be safe in use.

Other objects are to provide a pregnancy-supporting lounge chair, which is simple in design, inexpensive to manufacture, rugged in construction, easy to use, and efficient in operation.

These, and other objects, will be readily evident, upon a study of the following specification, and the accompanying drawing, wherein.

Figure 1:
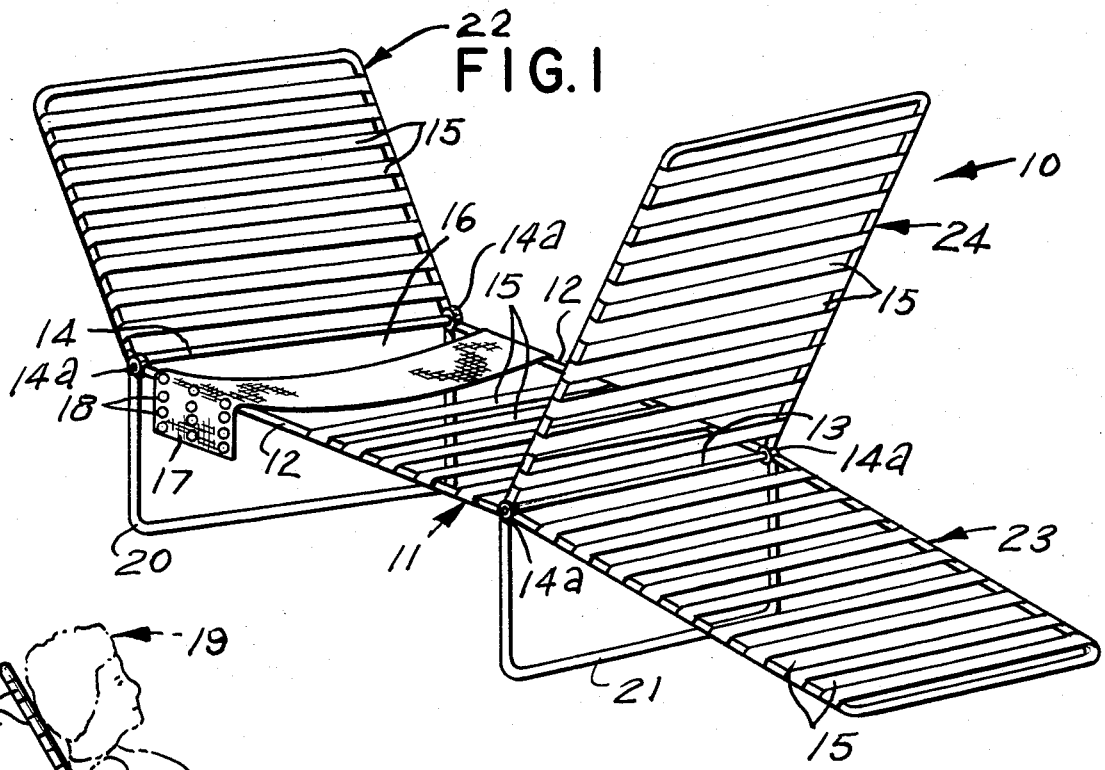
FIG. 1 is a perspective view of the present invention, showing the seat portion for covering the stomach support stretch band, in raised position.
Figure 2:
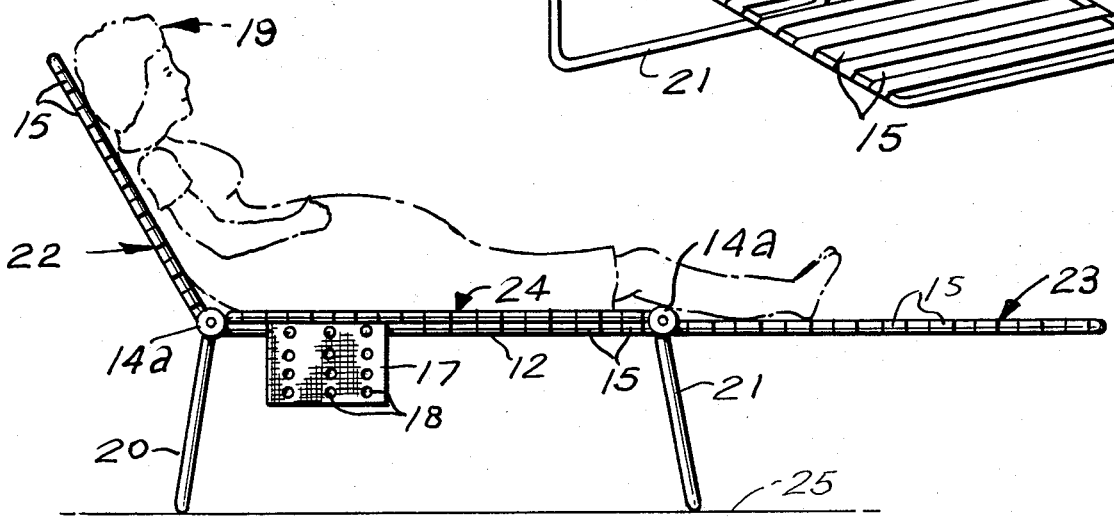
FIG. 2 is a side view of FIG. 1, shown in position for seating a person, who is shown in phantom lines.
Figure 3:
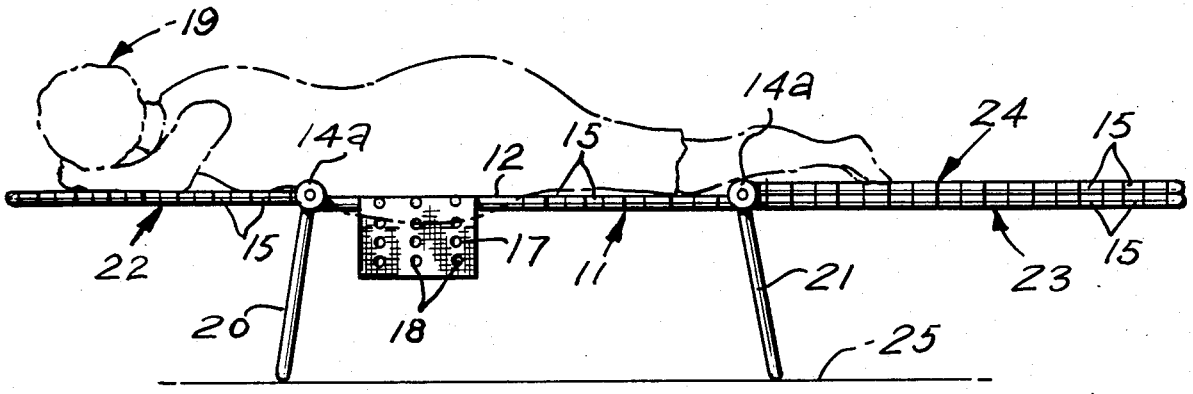
FIG. 3 is similar to FIG. 2, but illustrating the invention in position for supporting the person in the prone position.

According to this invention, a lounge chair 10 is shown to include a seat frame 11 of rectangular configuration, having a pair of tubular side members 12, and a pair of tubular end members 13 and 14 fixedly secured thereto, by suitable fastening means, not shown. A plurality of spaced-apart webbing strips 15 are fixedly secured to side members 12, in the manner common in the art, at the forward portion of seat frame 11, leaving a space 16 at the rear of seat frame 11. An adjustable stretch band 17 is fixedly secured, at one end, to one side member 12 by suitable fastening means, and the opposite end of band 17 is adjustably secured to the opposite side member 12, by suitable fasteners 18, so as to support the stomach area of a pregnant woman 19. A tubular leg 20 is hinged at its end portions, to rear end member 14, by hinges 14*a*, in a manner common in the art, and a second tubular member 21 is similarly hinged to the front end member 13 of seat frame 11, so as to fold for storage and transport purposes. A combination head and backrest frame 22, of tubular construction, is pivotally secured at its ends, to rear end member 14 of seat frame 11, in a suitable manner, and also includes webbing strips 15, for supporting the head and back of the woman 19. A footrest frame 23, of tubular construction, and including webbing 15, is also hinged to frame 11, at the forward end member 13, and a second seat frame 24, of tubular structure, is also hinged to seat frame 11 at its forward end member 13, so as to pivot down against seat frame 11, to cover the space 16, having the stretch band 17 therein. Second seat frame 24 also includes attached webbing 15.

In use, chair 10 is unfolded, by pivoting the legs 20 and 21 downwards from seat frame 11, into locking position, as is commonly known in the art. The combination head and backrest frame 22 is also pivoted away from seat rest frame 11, and locked, so as to support the head and back of the woman 19, when she is in the seated position. The footrest frame 23 is then pivoted away from seat frame 11, and aligns with, and locks in, the horizontal position, or may pivot downwards to have its front end touch the ground 25. After the above-mentioned is accomplished, the second seat frame 24 remains folded against seat rest frame 11, so as to cover space 16 and provide positive and comfortable seating for the woman 19.

When the woman 19 desires to lie down in the face-down, prone position, second seat frame 24 is pivoted away from seat frame 11, and is laid flat against footrest frame 23, so as to enable the stomach of the woman 19 to cradle comfortably in the pre-tensioned adjustment of the strength band 17, which extends over the space 16 in seat frame 11.

It shall be recognized, that the tension of the webbed strips 15, in all of its applications to chair 10, are of the same tension.

While various changes may be made in the detail construction, it is understood that such changes will be within the spirit and scope of the present invention, as is defined by the appended claims.

What we now claim is:

1. A pregnancy-supporting lounge chair, comprising, in combination, a first seat frame including support legs connected thereto, a second seat frame pivotally connected to one end of said first seat frame, a combination head and backrest frame pivotally secured to the other end of said first seat frame, a footrest frame connected to said one end of said first seat frame, body support means mounted on each of said first seat frame, said second seat frame, said combination head and backrest frame and said footrest frame, the body support means on said first seat frame being discontinuous, thereby forming an opening, and a stretch band secured to said first seat frame to span said opening, whereby when said second seat frame is in a first position overlying the footrest frame, said stretch band supports a pregnant woman's stomach area comfortably when she lies in a face-down prone position upon said first seat frame, said combination head and backrest frame and said footrest frame, and said second seat frame can be pivoted to a second position overlying said first seat frame to support the woman comfortably in a sitting position.

2. The combination according to claim 1, wherein said first seat frame is rectangular in configuration.

3. The combination according to claim 1, wherein said stretch band is adjustable.

* * * * *